US006241360B1

(12) United States Patent
Merrell

(10) Patent No.: US 6,241,360 B1
(45) Date of Patent: Jun. 5, 2001

(54) LIGHTED WRITING SUPPORT AND CLIPBOARD

(76) Inventor: Daniel B. Merrell, 3652 E. Dartmouth, Mesa, AZ (US) 85205

( * ) Notice: Subject to any disclaimer, the term of this patent is extended or adjusted under 35 U.S.C. 154(b) by 0 days.

(21) Appl. No.: 09/535,286

(22) Filed: Mar. 24, 2000

(51) Int. Cl.[7] ..... F21V 33/00

(52) U.S. Cl. ..... 362/99; 362/231; 362/234; 362/253; 362/184; 362/183

(58) Field of Search ..... 362/33, 98, 99, 362/234, 253, 231, 184, 183

(56) References Cited

U.S. PATENT DOCUMENTS

| | | | | |
|---|---|---|---|---|
| D. 330,258 | | 10/1992 | Schneiderman . | |
| D. 381,099 | | 7/1997 | Yuen . | |
| D. 405,551 | | 2/1999 | Lynch et al. . | |
| D. 417,019 | | 11/1999 | Rachwal et al. . | |
| 1,145,848 | | 7/1915 | Robins . | |
| 2,492,034 | | 12/1949 | Clyne . | |
| 3,215,453 | | 11/1965 | Malcom, Jr. . | |
| 3,232,685 | | 2/1966 | Wilstein et al. . | |
| 3,452,188 | | 6/1969 | Zidron et al. . | |
| 3,875,396 | * | 4/1975 | Webb | 362/99 |
| 4,057,730 | | 11/1977 | Dane . | |
| 4,153,927 | * | 5/1979 | Owens | 362/99 |
| 4,445,728 | | 5/1984 | Bratton . | |
| 4,751,615 | | 6/1988 | Abrams . | |
| 4,998,185 | | 3/1991 | DeNigris, Jr. | 362/98 |
| 5,163,748 | | 11/1992 | Messinger | 362/98 |
| 5,280,415 | | 1/1994 | Barnette | 362/99 |
| 5,381,310 | | 1/1995 | Brotz | 362/98 |
| 5,446,633 | | 8/1995 | Hanggi | 362/118 |
| 5,502,623 | | 3/1996 | Brotz | 362/99 |
| 5,607,223 | | 3/1997 | Brotz | 362/999 |

* cited by examiner

*Primary Examiner*—Stephen Husar
(74) *Attorney, Agent, or Firm*—Wells, St. John, Robert, Gregory & Matkin

(57) ABSTRACT

A lighted writing support may include an apparatus having a portable writing surface, a light assembly linked to the apparatus, and a switch for directing electrical power with the light assembly. The portable writing surface may comprise a handheld writing surface. The light assembly comprises a light source adapted to selectively emit when powered a first spectrum of light or a second spectrum of light different in a visible portion of the spectra from the first spectrum. A housing partially surrounding the light source may direct emitted light over the writing surface. The light source may comprise a first-type of light emitting diode (LED) to emit a first color of light and a second-type of LED to emit a second color of light. The first color may comprise light approximately red in appearance and the second color may comprise light approximately white in appearance. The light assembly may include a clamping surface biased against the writing surface to retain papers, documents, etc.

19 Claims, 5 Drawing Sheets

LIGHTED WRITING SUPPORT AND CLIPBOARD

TECHNICAL FIELD

This invention relates to writing supports, for example clipboards, having a light source.

BACKGROUND OF THE INVENTION

People engaged in a variety of vocations and activities often have a need to write or read under circumstances lacking adequate lighting. For example, police officers frequently write reports, write traffic tickets, or perform other writing tasks while in the field. Often, such writing activities occur at times of the day and in locations where no adequate lighting is available. Most officers carry a flashlight that may be used to illuminate a writing support, for example a clipboard. It is often awkward to both hold a flashlight and perform a writing or reading task. Another option is for an officer to use the internal lighting of a police vehicle as a light source, but this also generates other problems. For example, such an activity can create a hazardous circumstance. In the darkness, the internal lighting of a police vehicle may prevent an officer from being able to view activities outside the vehicle due to internal light reflection on the vehicle windows.

Pilots may have a need for an illuminated writing or reading surface when in flight. Typically, airplane cockpits are not lighted so that a pilot can clearly see out the cockpit windows at night. Firefighters, emergency medical personnel, military personnel, commercial truck drivers, train operators, and others are a few examples of people engaged in activities wherein an illuminated writing support may be desired.

Accordingly, a need exists to provide a lighted writing support, for example a clipboard, that fills the needs of individuals that engage in writing and reading activities where adequate lighting is not readily available.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
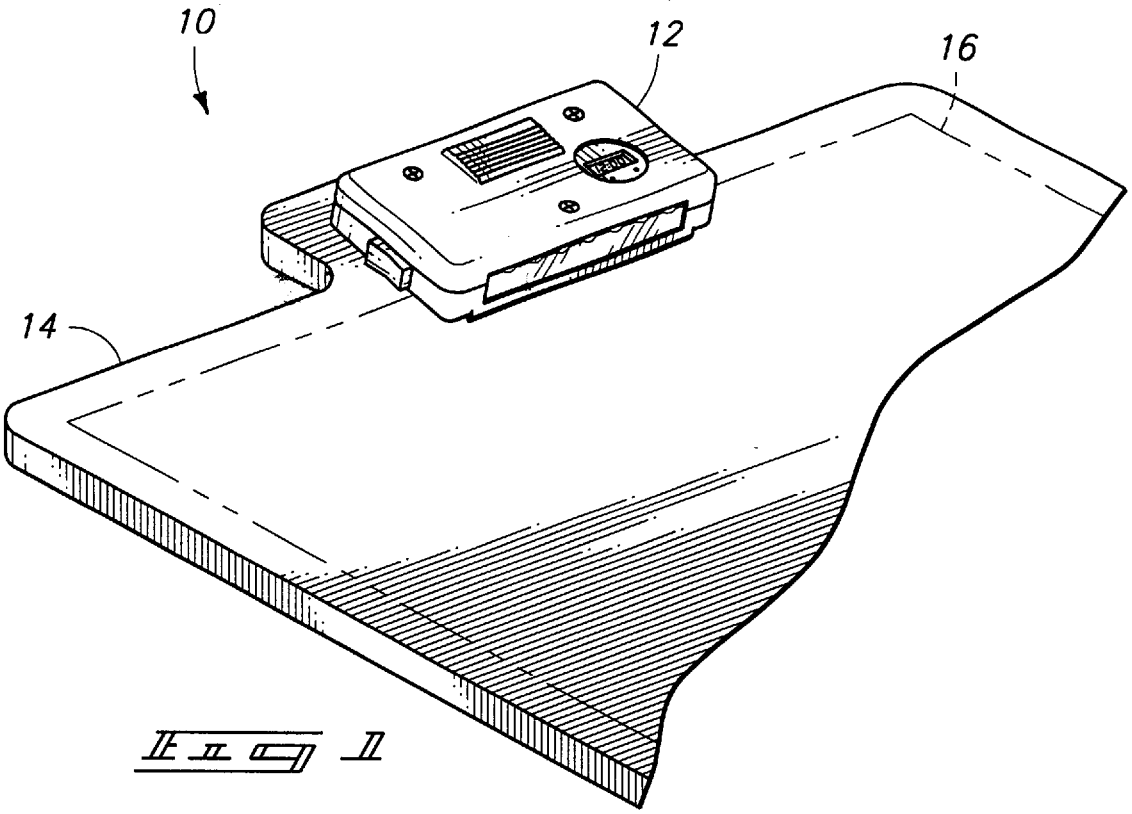
FIG. 1 shows a perspective, fragmentary view of a lighted clipboard according to one aspect of the invention.

This disclosure of the invention is submitted in furtherance of the constitutional purposes of the U.S. Patent Laws "to promote the progress of science and useful arts" (Article 1, Section 8).

According to one aspect of the invention a light assembly may comprise a light source adapted to selectively emit, when powered, a first spectrum of light or a second spectrum of light different in a visible portion of the spectra from the first spectrum. One advantage of the present aspect of the invention is that a first spectrum of light may be provided to illuminate an object during writing or reading in a circumstance where it is important to preserve night vision. That is, selected portions of the complete spectrum of visible light can be singled out to provide adequate illumination for reading or writing without causing substantial contraction of the pupil of the human eye. A spectrum of light that appears approximately red in color is an example of light spectra that may illuminate an object without causing substantial contraction of a pupil. Yellow-green may be another.

Of course, whether a given spectrum of light causes substantial contraction is related to the light intensity as well as the color appearance of the light. Typically, a spectrum of light that appears approximately red in color can be provided at an intensity that allows writing and/or reading activities without hampering night vision. Some spectra of light having a different color appearance at a similar intensity can impact night vision. For example, a spectrum of light appearing approximately white in color tends to cause substantial contraction. When a person viewing an object illuminated by such light looks away from the light into a darkened area, vision of the darkened area is hampered until the eyes dilate to adjust to the different illumination level. A spectrum of light appearing approximately red in color of similar intensity under similar circumstances typically only produces a slight contraction such that adjustment to the illumination level in a darkened area occurs more quickly. Such adjustment may even occur so quickly as to seem almost instantaneous. It is also conceivable that no contraction occurs so that no adjustment is needed. In the present invention, any spectrum of light and intensity of such light may be used for the first spectrum of light that does not substantially impact night vision as known to those skilled in the art.

In the context of this document, the term "spectrum of light" is defined to mean all or any portion of or multiple portions of electromagnetic radiation having a wavelength of from about 0.5 millimeters to about 0.5 nanometers. Such radiation includes, but is not limited to, the visible region of electromagnetic radiation ranging from about 430 nanometers to about 690 nanometers. Accordingly, the first spectrum of light referenced above may include light having a single range of wavelengths or may include light having multiple ranges of wavelengths.

As indicated, the light source may further emit a second spectrum of light different from the first in a visible portion of the spectra. That is, the second spectrum may include light having a wavelength between about 430 nanometers to about 690 nanometers that is not included in the first spectrum of light. Alternatively, the first spectrum of light may include a visible wavelength of light that is not included in the second spectrum. For example, the first spectrum of light may appear approximately red in color while the second spectrum of light may appear approximately white in color.

A spectrum of light that appears approximately white in color may comprise the complete visible region of light wavelengths between about 430 nanometers and about 690 nanometers. However, it is often difficult to provide a light source that emits the complete visible region of light wavelengths. For example, common household lighting typically does not include the complete visible region, but is nevertheless referred to as white light. Similarly, a spectrum of light that appears approximately white in color may be missing selected light wavelengths in the visible region.

Figure 3:
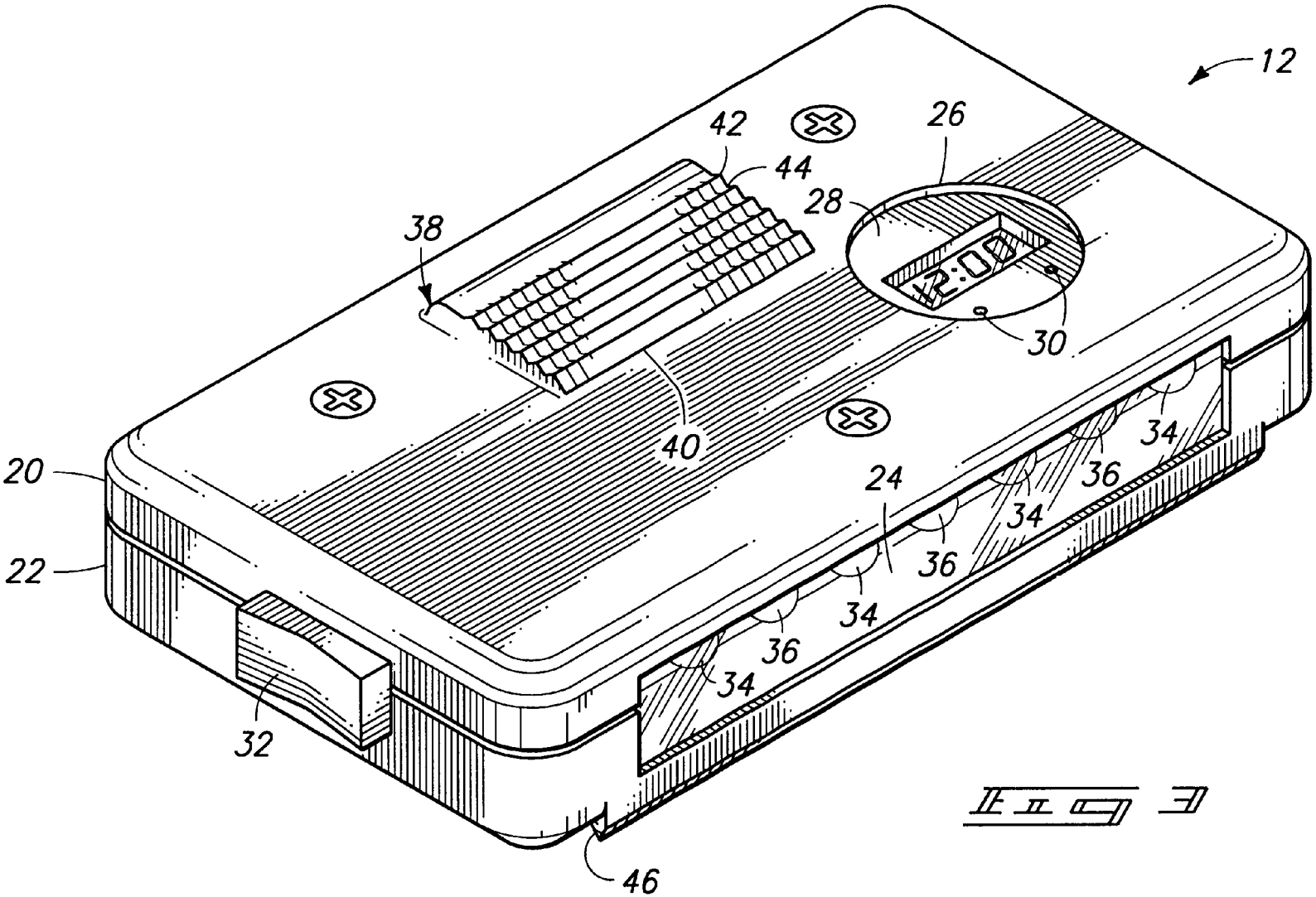
FIG. 3 shows an enlarged perspective view of a light assembly according to one aspect of the present invention.

A light assembly according to the present aspect of the invention may further include a housing at least partially surrounding the light source and having a structure and material properties sufficient to direct over an object some light emitted by the light source. Turning to FIG. 3, one example of a housing is illustrated. FIG. 3 shows a light assembly 12 including a top cover 20 and a bottom closure 22. A lense 24 is positioned in an aperture formed through top cover 20 and bottom closure 22 to allow light emitted from within light assembly 12 to be directed outside light assembly 12. Lense 24 shown in FIG. 3 comprises a substantially transparent material, for example clear plastic, such that the majority of the light emitted by the light source transmits through lense 24. However, a variety of other lense materials and structures are contemplated. A few examples include lenses that filter selected wavelengths of light, lenses that reduce the intensity of the light, diffusion lenses to "soften" the light, and others known to those skilled in the art.

The lense may wrap around the front of light assembly 12. Although not shown, the aperture formed through top cover 20 and bottom closure 22 may be formed through at least a portion of the front face of light assembly 12 and a portion of each of two opposing side faces, each side face portion being adjacent the front face portion. The lense may thus wrap around the front of light assembly 12 from one side face, to the front face, and to the other side face.

In FIG. 3, the light source is recessed within light assembly 12 such that light assembly 12 encases the light source. Such a housing may encase the light source to prevent exposure to weather and other potential damage. However, the invention contemplates that a housing may only partially surround a light source such that some components of a light source are encased while other components are not encased.

The light source may comprise a plurality of light-emitting diodes (LEDS) selectively powerable to emit a first color of light or a second color different from the first. The plurality of LEDs may comprise at least one first-type LED capable of emitting the first spectrum of light and at least one second-type LED capable of emitting the second spectrum of light. However, the present invention contemplates other light sources, including other LEDs. For example, incandescent, fluorescent, halogen, and other light sources commonly used for illumination may be included. Additionally, a single type of device may be included that is capable of emitting both the first spectrum of light and the second spectrum of light. It is conceivable that providing different amounts of electrical power to such devices may produce emission of different spectra of light. Also, providing electrical power to different portions of a single device may produce emission of different light spectra. One example is a lamp having multiple filaments, each filament producing a different spectrum of light.

For LEDs, the plurality of LEDs may also comprise a plurality of first-type LEDs to emit the first color and a plurality of second-type LEDs to emit the second color. Three or more LEDs of each type may also be provided as the light source. FIG. 3 shows that four white LEDs 34 are provided to emit a spectrum of light that appears approximately white in color and three red LEDs 36 are provided to emit a spectrum of light that appears approximately red in color. White LEDs 34 and red LEDs 36 are further illustrated in FIGS. 3, 5, and 9.

Figure 5:
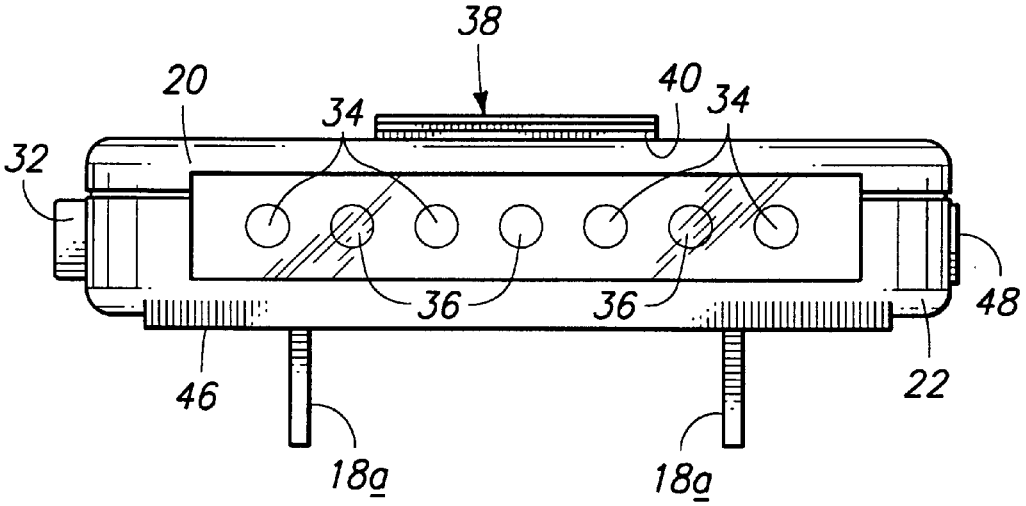
FIG. 5 shows a front view of the light assembly of FIG. 3.
Figure 6:
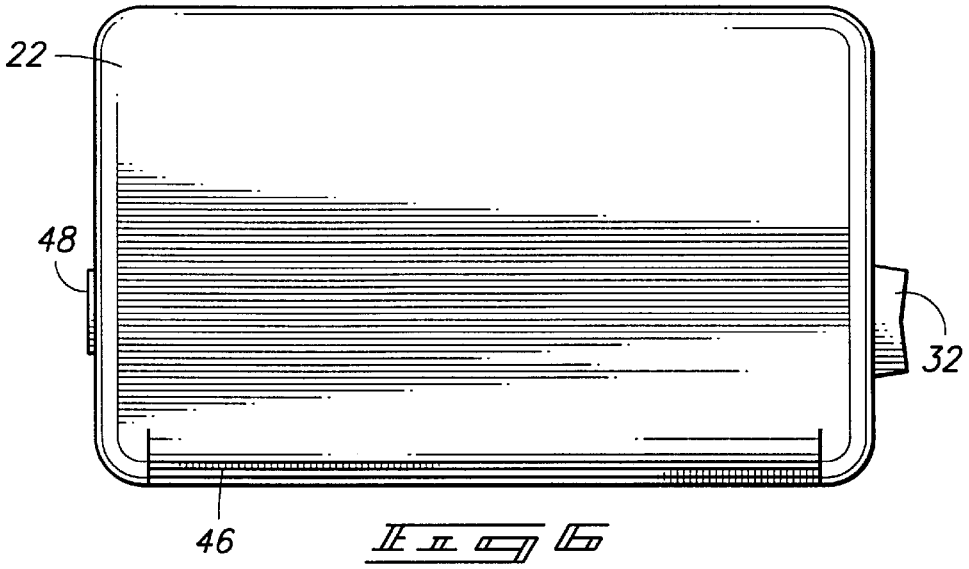
FIG. 6 shows a bottom view of the light assembly of FIG. 3.
Figure 9:
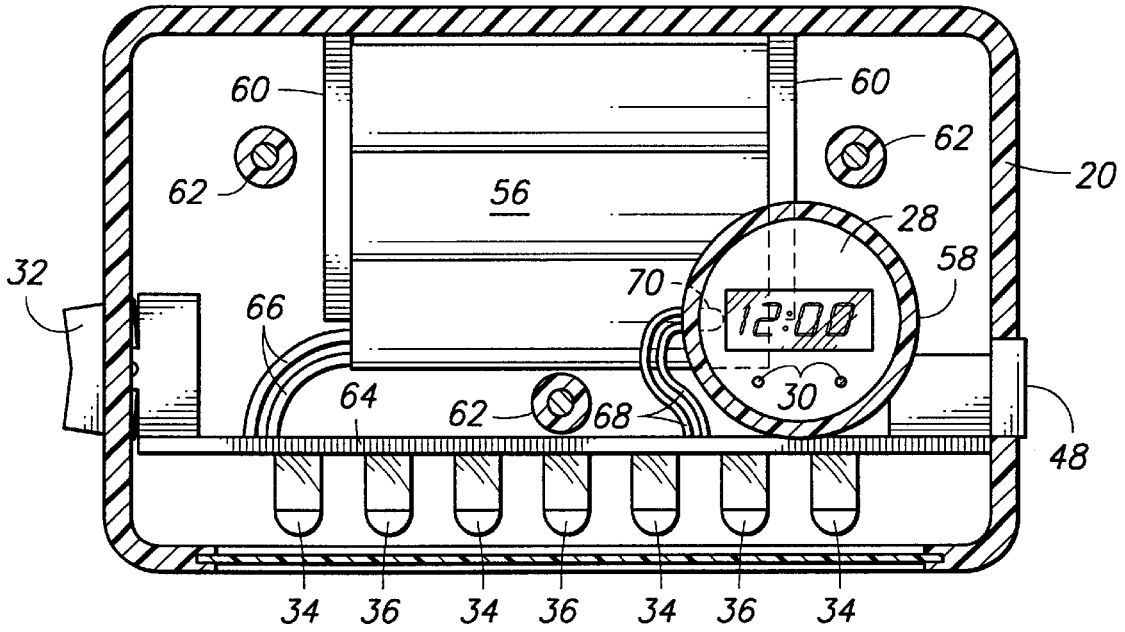
FIG. 9 shows a cross-sectional view of the light assembly of FIG. 3 taken along line 9—9 shown in FIG. 8.

FIGS. 3, 5, and 9 illustrate the alternated positioning of white LEDs 34 and red LEDs 36. A variety of different positions are also conceivable. However, the indicated positions for the LEDs provide a broad area of illumination for both colors extending from the front of light assembly 12.

An LED is typically not used to provide a spectrum of light that appears approximately white in color. However, a particular type of LED may be suitable to provide such light. An LED often includes an integral lense through which light emitted from the internal diode transmits. Accordingly, light generated by a diode may be altered by such a lense. For a diode generating primarily yellow light, a phosphorous-comprising or other material as known to those skilled in the art may be included in the diode lense to alter light emitted from the LED to appear approximately white in color. Such light may exhibit a slight bluish hue, but nevertheless appears approximately white.

Red LEDs 36 provide a source of illumination that may allow a user to write and read without substantially impairing night vision. In addition, such illumination does not readily reveal the location of an individual illuminating an object with such light. Such may be advantageous to an individual who desires to conceal their location while writing or reading.

Turning to FIG. 9, the cross-sectional view of light assembly 12 reveals internal components. White LEDs 34 and red LEDs 36 are shown electrically connected to a printed circuit board (PCB) 64. A PCB is preferred to connect the various components of light assembly 12 and direct electrical power where desired. However, the present invention also contemplates electrically connecting various components of light assembly 12 using other than a PCB.

An advantage of providing PCB 64 is that such device may include circuitry desired for the operation of the LEDs. Often, LEDs include an internal resistor for regulating current flow to the diode portion of an LED. Because two different types of LEDs may be included in light assembly 12, some LEDs may include internal resistors while others do not. PCB 64 comprises a simple mechanism for providing in-line resistors for any LEDs that do not include internal resistors. PCB 64 also provides a simple mechanism for including additional circuit elements. For example, because switch 32 powers PCB 64 in two switch positions, a diode may be included to prevent back flow of current and powering of one set of LEDs when the other set of LEDs is already powered.

A variety of other structures may be included to assist in directing emitted light over an object. For example, an internal reflector may be provided to direct light out of light assembly 12. PCB 64 may comprise a convenient surface on which a reflective material may be formed. However, LEDs often direct light in a general direction as a consequence of their structure. Thus, LEDs may be aligned in particular positions within light assembly 12 to direct light where desired.

A power supply 56 is provided within light assembly 12 and held in position by retainers 60 and the outer walls of top cover 20 and bottom closure 22. Power leads 66 connect power supply 56 to PCB 64. Power supply 56 may comprise a rechargeable power supply, including a rechargeable battery. The invention further contemplates that a power supply external to light assembly 12 may alternatively provide electrical power to the light source of light assembly 12. A jack 48 is shown electrically connected to PCB 64. Jack 48 may be capable of electrical connection with an external power supply to power the light assembly. An external power supply may include an automobile electrical system as accessed through a cigarette lighter receptacle. Commonly available domestic or industrial electricity as accessed through an alternating current outlet is another example. Jack 48 may provide an external power supply to recharge power supply 56, if rechargeable, or simply to provide an alternate power source. Light assembly 12 may include an internal power supply such that light assembly 12 is portable without constant dependence on external power.

Power supply 56 is shown electrically connected to PCB 64, which is in turn electrically connected to switch 32. Switch 32 may comprise a rocker-type of switch, as well as other switch types. Switch 32 may be capable of directing electrical power to the light source to emit the first spectrum of light when in a first switch position and to emit a second spectrum of light when in a second switch position. Since light assembly 12 includes white LEDs 34 and red LEDs 36, switch 32 may selectively power such LEDs to emit a first color at a first switch position and a second color at a second switch position. In this manner, a user may easily select the type of lighting desired.

Figure 4:
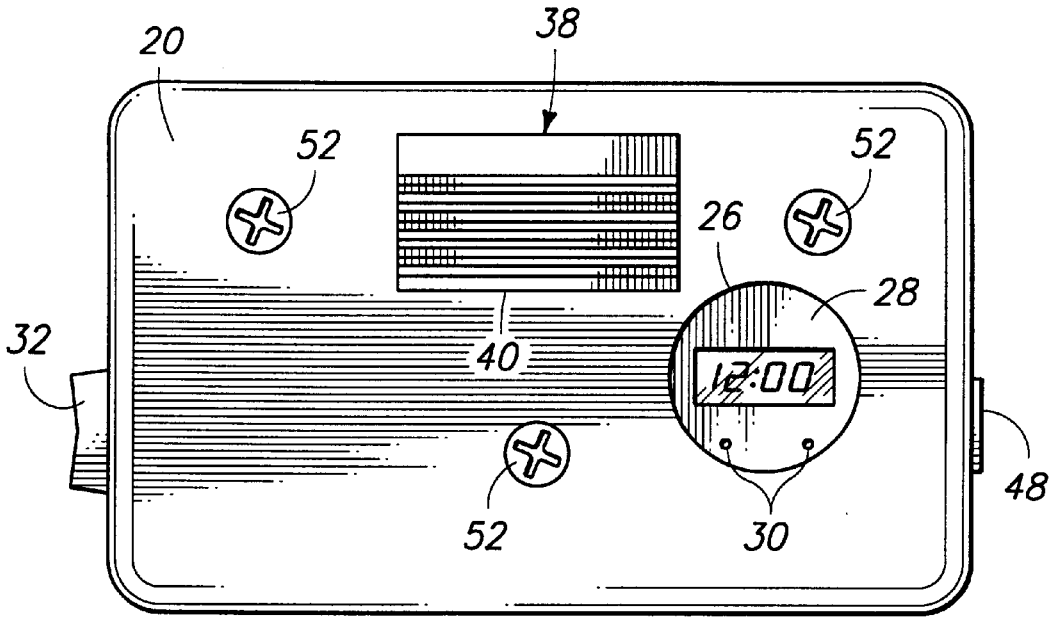
FIG. 4 shows a top view of the light assembly of FIG. 3.

Light assembly 12 may further comprise a clock that is backlit by a second light source when such second light source is powered. FIG. 9 shows a clock 28 mounted within a clock housing 58. FIGS. 3 and 4 further show a clock aperture 26 formed through top cover 20 exposing clock 28 to view. Clock buttons 30 are also provided on the face of clock 28 to control the functions of such clock. The present invention contemplates a variety of types of clocks, including electrical as well as mechanical clocks. Electrical clocks may possess an independent internal power source, such as a clock battery, or may derive power from power supply 56. Clock 28 may be backlit by a second light source different from the white LEDs 34 and red LEDs 36.

In FIG. 9, a green LED 70 is shown positioned behind the face of clock 28 at a position sufficient to illuminate the readout of clock 28. Backlight leads 68 electrically connect green LED 70 to PCB 64 and, in turn, to power supply 56. Operation of green LED 70 may be associated with operation of white LEDs 34 and red LEDs 36. For example, green LED 70 may backlight clock 28 when switch 32 is both in the first and second switch position. In this manner, clock 28 may be illuminated whenever either of the two types of LEDs are powered. Green LED 70 or some other third-type of LED different from either of white LEDs 34 or red LEDs 36 may produce a different intensity of light compared to white LEDs 34 and red LEDs 36. Typically, much less illumination is required for a clock face compared to a writing or reading surface.

As described above, light assembly 12 may be operated independently of a writing or reading support. A variety of attachment mechanisms (not shown) may be provided in association with light assembly 12 to enable positioning of light assembly 12 convenient to performing writing and reading tasks. However, in another aspect of the invention, light assembly 12 may be linked to an apparatus having a structure and dimensions sufficient to provide a handheld writing surface. A portable board, for example the board of a conventional clipboard, may provide a suitable writing surface. In this manner, a lighted writing support, such as a lighted clipboard, may be provided.

The structure of an apparatus providing a handheld writing surface is typically sufficiently rigid and hard such that paper, documents, etc. may be placed and supported thereon while writing on such materials or reading. Such an apparatus may include dimensions that also support such paper and documents as well as enable holding such apparatus in one hand while writing with another hand. It is conceivable that instead of only providing a handheld writing surface such apparatus may provide a portable writing surface that may be handheld or supported by a mechanism or device instead of being handheld. Conventional clipboards are suitable for use as an apparatus having structure and dimensions sufficient to provide a portable board having a writing surface as well as for use as a handheld writing surface. Clipboards may possess dimensions corresponding to the dimensions of papers, documents, etc. most frequently used on such clipboards. Common sizes include clipboards for 8.5×11 inch and 8.5×14 inch sheets of paper. Clipboards may be constructed of wood, metal (including aluminum), particle board, paperboard, etc.

A light source, for example light assembly 12, may be linked to an apparatus providing a writing surface in a position relative to the writing surface to direct some light emitted by the light source over the writing surface. FIG. 1 shows a lighted clipboard 10 including light assembly 12 linked to a board 14 and positioned relative to paper 16 on board 14 to direct emitted light over paper 16.

Figure 2:
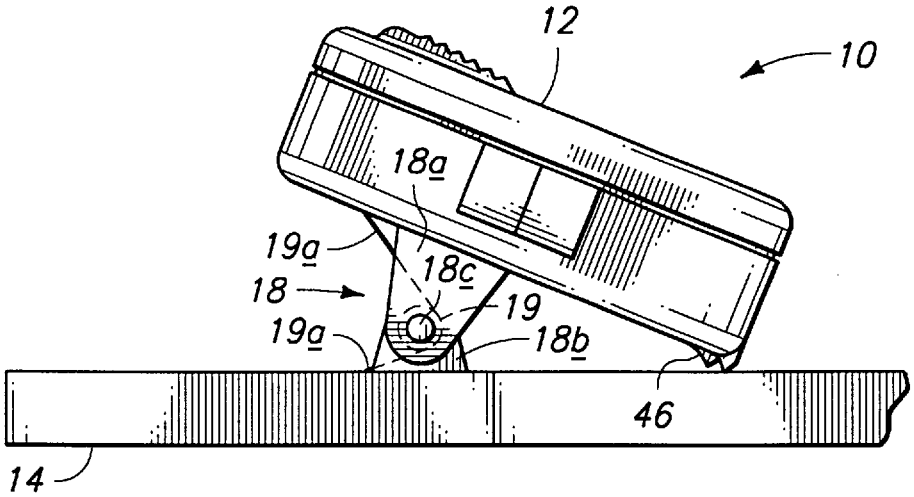
FIG. 2 shows a side view of the lighted clipboard fragment of FIG. 1.
Figure 7:
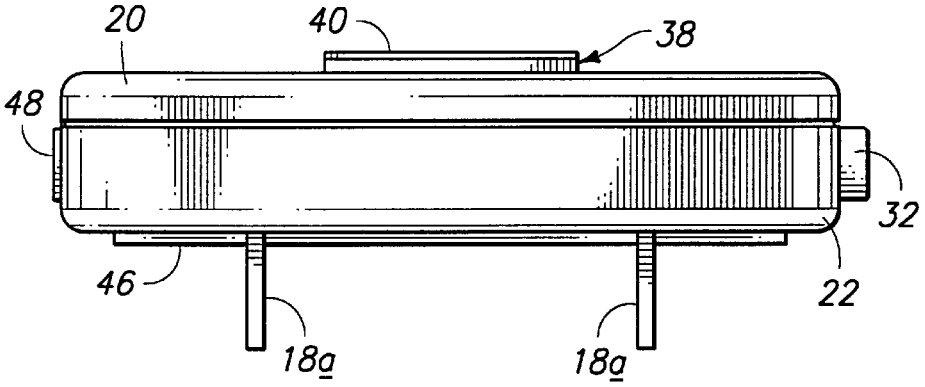
FIG. 7 shows a rear view of the light assembly of FIG. 3.
Figure 8:
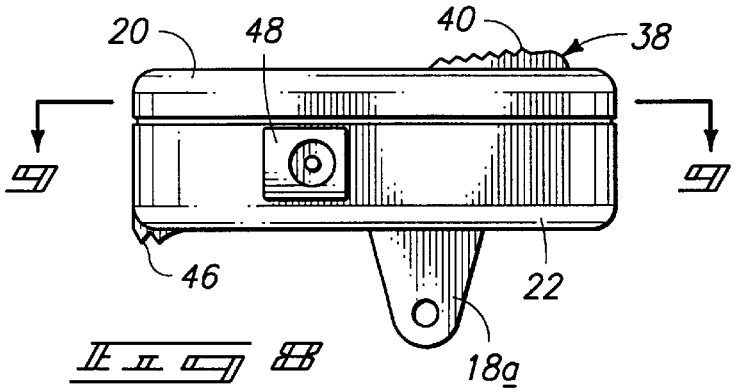
FIG. 8 shows one side view of the light assembly of FIG. 3.

A lighted writing support may include a biasing mechanism attached to an apparatus providing a writing surface and attached to a housing at least partially surrounding a light source such that a clamp surface of the housing is biased against the writing surface. The biasing mechanism may comprise a variety of spring mechanisms and the clamp surface may comprise a variety of gripping structures. Turning to FIG. 2, lighted clipboard 10 provides one example of such a biasing mechanism. A spring-loaded hinge 18 is shown linking light assembly 12 to board 14. Spring-loaded hinge 18 includes a coiled spring 19 having two spring arms 19*a*, wherein one spring arm may be biased against light assembly 12 and another spring arm may be biased against board 14. Hinge plates 18*a* attached to light assembly 12 may be linked to hinge plates 18*b* attached to board 14 by hinge pin 18*c*. FIGS. 5, 7, and 8 show hinge plates 18*a* in additional detail. Light assembly 12 may pivot about hinge pin 18*c*. Other types of spring-loaded hinges known to those skilled in the art may be substituted for spring-loaded hinge 18. Also, instead of a spring-loaded hinge, a spring having at least two spring arms attached respectively to light assembly 12 and board 14 may be provided as a biasing mechanism. Such a spring may provide structural support as well as biasing without the need for a hinge pin.

As viewed in particular in FIGS. 3 and 8, light assembly 12 includes a clamp surface 46 that is biased against board 14 by spring 19. Clamp surface 46 is shown to include teeth as one example of possible gripping structures. The teeth of clamp surface 46 and other gripping structures or materials may provide added restraint to papers, documents, etc. against which clamp surface 46 is biased. That is, more restraint than achievable by the surface of light assembly 12 that would contact such papers and documents in the absence of clamp surface 46.

It can be seen from FIG. 2 that the bias of spring 18 may be counteracted to lift clamp surface 46 away from board 14 by pressing against light assembly 12. Accordingly, light assembly 12 may include an exterior portion that enhances a user's grip in an area that may be pressed against to counteract the bias of spring 18. One example is shown in particular in FIGS. 3, 4, 5, and 8. A grip 38 shaped as a ramp is provided with knurling 40 on an exterior portion of light assembly 12. In the example illustrated, knurling 40 includes a series of alternated ridges 42 and grooves 44. Knurling 40 essentially provides a textured surface on ramp-shaped grip 38 to more easily press against light assembly 12 in an area that most effectively counteracts the bias of spring 18. In this manner, papers, documents, etc. may be easily retained and released from lighted clipboard 10.

FIG. 4 shows screws 52 that attach top cover 20 to bottom closure 22. FIG. 9 shows screw housings 62 through which screws 52 are inserted to join top cover 20 to bottom closure 22.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A lighted writing support comprising:

a) an apparatus having a structure and dimensions sufficient to provide a handheld writing surface;

b) a light assembly linked to the apparatus, the light assembly comprising:

i) a light source adapted to selectively emit when powered a first spectrum of light or a second spectrum of light different in a visible region of the spectra from the first spectrum; and ii) a housing at least partially surrounding the light source and having a structure, a position relative to the writing surface, and material properties sufficient to direct over the writing surface some light emitted by the light source; and c) a switch capable of directing electrical power to the light source to emit the first spectrum when in a first switch position and to emit the second spectrum when in a second switch position.

2. The lighted writing support of claim 1 wherein the light assembly further comprises a clamp surface on an exterior portion of the housing and wherein a mounting device comprising a spring links the light assembly to the apparatus and the spring biases the clamp surface against the writing surface.

3. The lighted writing support of claim 2 wherein the clamp surface comprises teeth.

4. The lighted writing support of claim 1 wherein a hinge pin links a hinge plate of the light assembly to a hinge plate of the apparatus and a spring biases a clamp surface of the light assembly against the apparatus.

5. The lighted writing support of claim 1 wherein the light source comprises at least one first-type light emitting diode (LED) capable of emitting the first spectrum of light and at least one second-type LED capable of emitting the second spectrum of light.

6. The lighted writing support of claim 5 wherein the at least one first-type LED comprises three or more and the at least one second-type LED comprises three or more.

7. The lighted writing support of claim 1 wherein the light source is recessed within the housing such that the housing encases the light source and wherein the housing further comprises a lens in a light source aperture to allow emitted light to illuminate the writing surface.

8. The lighted writing support of claim 1 wherein the light assembly further comprises a clock mounted to the housing and backlit by a second light source when such light source is powered.

9. The lighted writing support of claim 1 wherein the light assembly further comprises an internal power supply electrically connected to the switch.

10. The lighted writing support of claim 1 wherein the light assembly further comprises a jack capable of electrical connection with an external power supply to power the light assembly.

11. The lighted writing support of claim 1 wherein the first spectrum of light appears approximately red in color to the human eye and the second spectrum of light appears approximately white in color to the human eye.

12. A lighted clipboard comprising:

a portable board having a writing surface;

a biasing mechanism attached to the board;

a housing attached to the biasing mechanism, wherein a clamp surface of the housing is biased against the writing surface;

a plurality of light emitting diodes (LEDs) encased in the housing and selectively powerable to emit a first color of light or a second color different from the first; and a switch to selectively power the LEDs to emit the first color at a first switch position and the second color at a second switch position.

13. The lighted clipboard of claim 12 wherein the plurality of LEDs comprises a plurality of first-type LEDs to emit the first color and a plurality of second-type LEDs to emit the second color.

14. The lighted clipboard of claim 13 wherein the biasing mechanism consists essentially of a spring-loaded hinge.

15. The lighted clipboard of claim 13 further comprising a clock mounted to the housing, wherein the switch powers clock backlighting when in the first switch position and the second switch position.

16. The lighted clipboard of claim 13 wherein the first color appears approximately red to the human eye and the second color appears approximately white to the human eye.

17. A lighted clipboard comprising:

a) an apparatus having a structure and dimensions sufficient to provide a handheld writing surface;

b) a spring having a first arm biased against the apparatus and a second arm;

c) a light assembly against which the second arm of the spring is biased, the light assembly comprising:

i) at least one first-type light emitting diode (LED) that emits a first spectrum of light when powered;

ii) at least one second-type LED that emits a second spectrum of light different from the first-type when powered;

ii) a housing encasing the LEDs and directing over the writing surface some light emitted by the LEDs;

iii) a clamp surface on an exterior portion of the housing, wherein the spring biases the clamp surface against the writing surface;

iv) a knurled surface positioned on an exterior portion of the housing such that pressing against the housing at the knurled surface counteracts the spring bias and lifts the clamp surface away from the writing surface; and iv) a clock mounted to the housing and backlit by at least one third-type LED when such LED is powered; and d) a switch capable of directing electrical power to the LEDs to emit the first spectrum when in a first switch position, to emit the second spectrum when in a second switch position, and to backlight the clock when in both the first and second switch position.

18. The lighted clipboard of claim 17 wherein the at least one first-type LED comprises three or more and the at least one second-type LED comprises three or more.

19. The lighted clipboard of claim 18 wherein the light assembly further comprises an internal, rechargeable power supply.

* * * * *